United States Patent [19]

Ito et al.

[11] 4,324,620

[45] Apr. 13, 1982

[54] PYROLYZING APPARATUS

[75] Inventors: Kanichi Ito, Yokohama; Yoshio Hirayama, Zushi; Yoshiaki Ishii; Naoyoshi Ando, both of Yokohama, all of Japan

[73] Assignee: Ebara Corporation, Tokyo, Japan

[21] Appl. No.: 100,406

[22] Filed: Dec. 5, 1979

[51] Int. Cl.[3] ..... C10B 15/00; C10B 21/10; C10B 49/10; C10B 49/22

[52] U.S. Cl. ..... 202/89; 48/197 A; 48/206; 201/1; 201/31; 202/215

[58] Field of Search ..... 422/142, 144, 112; 48/197 A, 206; 201/1, 12, 15, 16, 25, 31; 202/88, 89, 215

[56] References Cited

U.S. PATENT DOCUMENTS

| | | | |
|---|---|---|---|
| 2,527,197 | 10/1950 | Rollman | 48/206 |
| 2,667,448 | 1/1954 | Munday | 422/142 |
| 2,763,597 | 9/1956 | Martin et al. | 422/144 |
| 2,898,290 | 8/1959 | Swabb | 422/144 |
| 3,853,498 | 12/1974 | Ballie . | |
| 4,082,615 | 4/1978 | Komuro et al. | 201/29 |

FOREIGN PATENT DOCUMENTS 785994 11/1957 United Kingdom .

OTHER PUBLICATIONS

"Fluidization Engineering"; pp. 395–405, 1969.

*Primary Examiner*—Bradley Garris

*Attorney, Agent, or Firm*—Wenderoth, Lind & Ponack

[57] ABSTRACT

A pyrolyzing apparatus having a pyrolysis fluidized bed chamber and an incineration fluidized bed chamber or chambers each directly adjacent and communicated with the pyrolysis fluidized bed chamber through an opening or openings in a partition wall above a common perforated bottom plate, the respective levels of the fluidized beds being controlled by regulating the pressure(s) in free board(s) of the fluidized bed chambers.

9 Claims, 10 Drawing Figures

PYROLYZING APPARATUS

FIELD OF INVENTION

The present invention relates to a thermal reactor and more particularly to a pyrolyzing apparatus of a fluidized bed type for pyrolyzing or thermally decomposing organic materials.

BACKGROUND OF INVENTION

Disposal of waste is becoming a serious problem due to the huge volume thereof increasing from year to year. On the other hand, recovering useful constituents from the refuse waste has been considered and several methods and apparatuses have been developed. Usually, constituents of the municipal waste are more or less incinerated for disposal. However, mere incineration may result in loss of some usable constituents and environmental pollution.

Pyrolysis gas may be recovered from organic materials by thermally decomposing or pyrolyzing the same. The pyrolysis gas thus recovered may be utilized for several purposes, for example as fuel, material for producing chemical resources, etc.

Heretofore, several pyrolyzing apparatuses have been used for thermally decomposing the organic refuse to recover pyrolysis gas therefrom and a thermal reactor of a fluidized bed type has been found to be useful to such end.

However, when a thermal reactor of a single fluidized bed type is employed, it is necessary to supply an appropriate amount of heat for maintaining endothermetic reaction by incinerating a part of the organic materials intended to be pyrolyzed for recovering the pyrolysis gas therefrom. Accordingly, pyrolysis gas generated by thermal decomposition or pyrolyzing is diluted or thinned with exhaust gas thereby considerably lowering the calorific content of the recovered gas and, thus, degrading the quality of the recovered pyrolysis gas. Further, carbon adheres to the surface of the inert particles or grains used to form the fluidized bed thereby making it impossible to maintain the condition of fluidized bed substantially stable. Therefore, in order to maintain the preferable condition, grains with carbon adhering thereto must be constantly or periodically removed from the reactor for restoration or regeneration by a separately provided apparatus which adds complexity to a total system and operation.

The above drawbacks may be overcome to some extent if a two bed pyrolysis system is utilized wherein a pyrolysis fluidized bed and an incineration fluidized bed are parallely arranged between which two inclined conduits are disposed so as to circulate particles or grains between the two beds through the conduits such that the necessary heat in the pyrolyzing bed for maintaining the pyrolysis process is supplied by the above-noted circulation. In this system, the generated pyrolysis gas will not be diluted by the exhaust gas whereby pyrolysis gas having a high calorie content is obtained and, further regeneration of the grains is effectively and automatically performed during the circulation of the grains within the system. Therefore, the two bed process above is considered to be a very efficient system.

However, in order to make the transfer of the grains in the conduits of the two bed system smooth, it is necessary to dispose the conduits steeply, with an angle of inclination greater than the angle of repose for the grains and this makes it necessary to increase the height of the fluidized bed. Accordingly, the total height of the apparatus becomes great and this may increase the installation expense and, further, the operation becomes complex and troublesome.

Further, it is difficult to induce or maintain smooth fluidizing as the fluidized bed becomes higher. On the other hand, in case municipal waste is charged into the pyrolyzing apparatus, it is necessary to remove non-organic residue such as glass and metals. Therefore, if the two bed pyrolysis system is utilized, two discharge openings are generally required to remove such residue. In this case the device and the operation required for removing the residue at two places become troublesome and complex.

Further, removal of such residue is a dangerous operation, particularly in case from the pyrolyzing bed section since leaking of the pyrolysis gas generated by pyrolyzing or injected into the bed for fluidization creates the possibility of fire and/or explosion and, thus, provision of a safety device at each of such discharge openings is mandatory for the sake of safety. Therefore, removal of such residue at more than one place is not recommended.

SUMMARY OF INVENTION

Accordingly, there has been a need for an apparatus for pyrolyzing organic refuse without encountering the drawbacks of the prior art such as discussed above.

Thus, it is an object of the present invention to provide an apparatus for pyrolyzing or heat decomposing organic refuse or the like which is free from the drawbacks of the prior art.

Also, it is an object of the present invention to provide an apparatus for pyrolyzing organic refuse or the like to recover pyrolysis gas having high calorific content from the refuse.

It is still another object of the present invention to provide an apparatus of a fluidized bed type for pyrolyzing organic refuse or the like wherein inert solid particles and/or grains forming the fluidized bed are regenerated during the process.

It is also another object of the present invention to provide a pyrolyzing apparatus for recovering pyrolysis gas from the municipal waste wherein the number of discharge openings for removing residue is made minimum.

All of the objects above are attained by a pyrolyzing apparatus constructed according to the present invention.

A pyrolyzing apparatus of the present invention is constructed to have two kinds of chambers, namely, a pyrolysis fluidized bed chamber and an incineration fluidized bed chamber communicating with each other at the respective bottom portions of the beds and above the common base or bottom diffusion plate and the internal pressure in the upper portion of the chamber or the free board in each of the chambers is varied with the time of operation so that the pressure difference created between the chambers effects the movements of the particles or grains between the chambers.

Although two chambers are provided in the present invention, the height of the apparatus is relatively low compared to the two bed pyrolysis system of the prior art and discharge of residue is possible at only one position. Further, such discharging or removing of residue may be performed at a place not having a combustible gas atmosphere, in contrast to the prior art process in which removal of the residue is at a place where the pyrolysis gas is present.

The number of the chambers is not limited to two which may be clarified in the ensuing description.

The other objects and advantages of the present invention will become more clear when the description of the preferred embodiments is reviewed which follows the brief explanation of the drawings summarized below.

DESCRIPTION OF PREFERRED EMBODIMENTS

Figure 1:
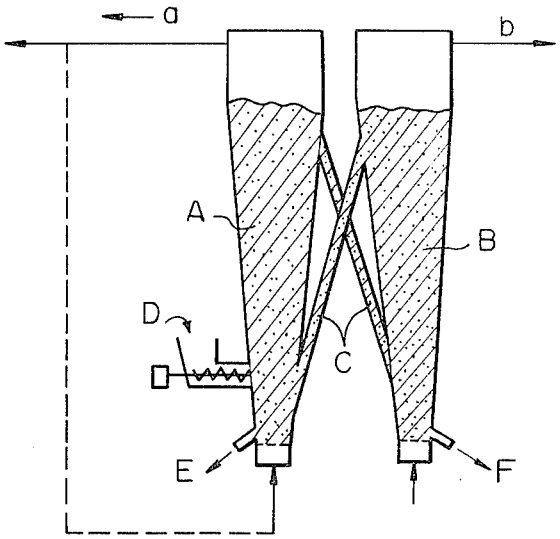
Fig. 1 (PRIOR ART)
FIG. 1 is a schematic illustration of an apparatus of a twin bed pyrolysis system according to a prior art.

Before describing the embodiments according to the present invention, an example of a prior art is briefly touched upon with reference to a two bed pyrolysis system schematically illustrated in FIG. 1. As shown in this drawing, a pyrolysis fluidized bed A and an incineration fluidized bed B are parallelly disposed between which two conduits C are arranged to make communication between the beds A and B.

As illustrated in FIG. 1, the inclination of the conduits C is considerably steep for the reason explained hereinbefore whereby the system becomes rather high although the regeneration of the grains is automatically effected and a pyrolysis gas of high grade is obtained by this system. A feeder D is arranged to feed the materials into the bed A. At the portions above the beds A and B, respectively, pyrolysis gas generated is taken out as indicated by an arrow "a," a portion of which may be recirculated to a bottom gas chamber of the bed A to fluidize the grains of the bed A. Thus, the residue descended to the bottom of the bed A is to be removed from a discharge opening E where combustible pyrolysis gas is present and, accordingly, discharging the residue at the opening E is dangerous. Exhaust gas generated in the incineration bed B is directed outwardly as indicated by an arrow "b." At the bottom of the bed B, the non-combustible residue is to be discharged out of a discharge opening F adjacent the bottom diffusion plate, through which air is blown upwardly to fluidize the grains of the bed B, whereby the operation of the system is troublesome.

Figure 2:
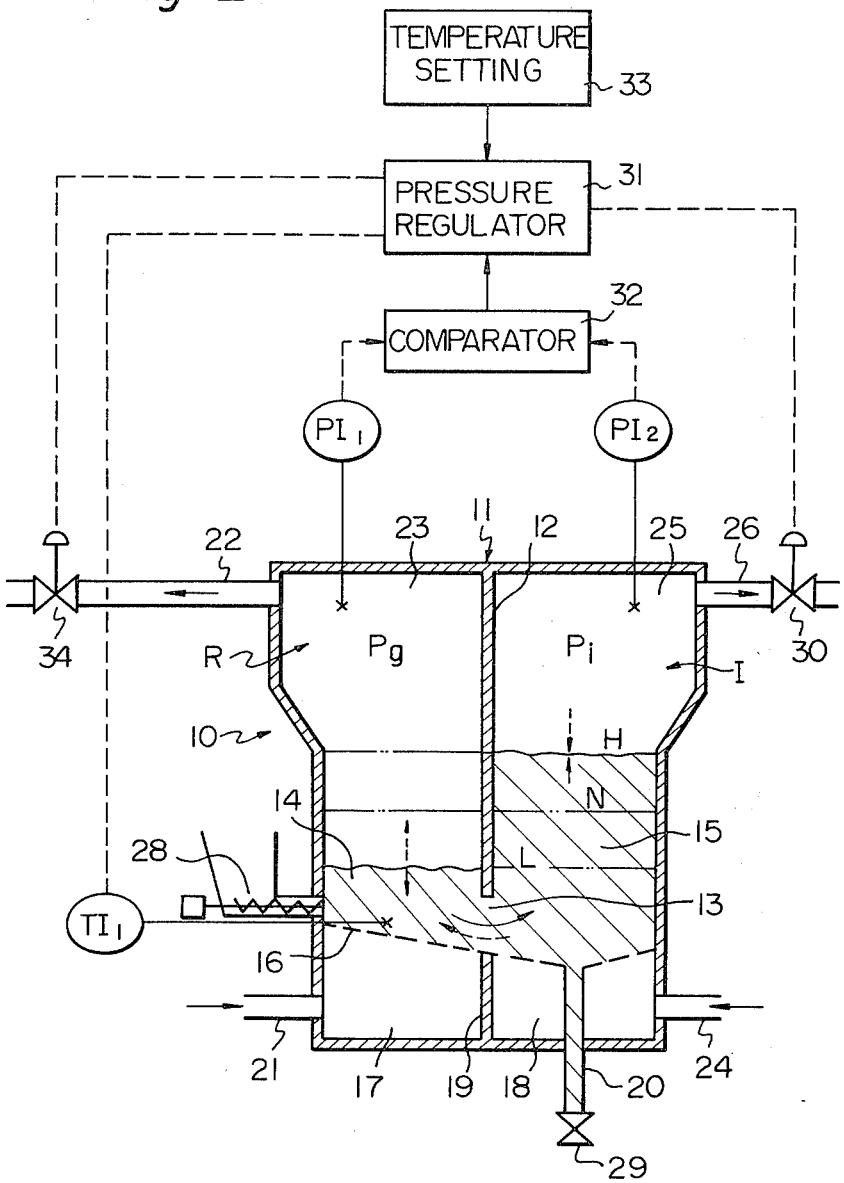
FIG. 2 is a schematic illustration in cross section showing a pyrolyzing apparatus according to the present invention.

Referring to FIG. 2, a pyrolyzing apparatus 10 according to the present invention is schematically illustrated in a sectional view in which a vessel 11 thereof is divided by a partition wall 12 into a pyrolysis fluidized bed chamber R and an incineration fluidized bed chamber I. The partition wall 12 is provided with a communication opening 13 so as to provide communication between the chambers R and I at the respective bottom portions of fluidized beds 14 and 15. As is usual in the fluidized bed, a gas diffusion plate or a perforated bottom plate 16 is disposed within the vessel 11 to provide a pyrolysis gas chamber 17 and a combustion or incineration gas chamber 18, the chambers 17 and 18 being separated from each other by a partition wall or dividing wall 19. The perforated bottom plate 16 is preferably given an inclination such as illustrated in FIG. 2 so that, at approximately the center of the bottom of the fluidizing bed 15, the plate 16 is arranged to be the lowest level where a residue discharge duct 20 communicates with the bottom of the bed 15. The partition wall 19 is preferably aligned in a vertical direction with the partition wall 12. The pyrolysis gas chamber 17 is connected with a gas duct 21 through which an inert gas (oxygen free) is fed thereinto to fluidize inert solid grains above the bottom plate 16, the inert gas being for example, steam or a part of the pyrolysis gas generated in the chamber R and pumped out from an outlet conduit 22 connected to the chamber R at the upper part of a free board section 23 thereof.

The incinerating gas chamber 18 is also connected to a pressurized air source through an air conduit 24 so as to fluidize the inert solid grains on the bottom plate 16. At the upper portion of a free board 25 of the chamber I, an outlet duct or exhaust pipe 26 is provided so as to discharge the exhaust gas therethrough. A feeder 28, shown as a screw conveyor, is disposed so as to charge materials to be processed into the vessel 11. In the discharge duct 20, an appropriate double valve 29 is disposed for discharging residue therethrough, as required.

The basic principle for operating the pyrolyzing apparatus 10 is relying on the nature of the fluidizing bed to behave substantially in the same way as a liquid. In operation, the pressure Pg in the free board 23 of the pyrolysis chamber R is arranged or kept to be substantially constant while the pressure Pi in the free board 25 of the incineration chamber I is varied preferably with time or with the temperature sensed in the fluidized beds, preferably in the pyrolysis bed 14 so that the difference between the pressures Pg and Pi is alternately made to be positive and negative as graphically illustrated in FIG. 3. Such an alternating pressure variation will cause the reciprocal movement of the inert solid grains between the fluidized beds 14 and 15. A method or means for controlling the pressures Pg and Pi or the movement of the solid grains between the beds will be explained separately. The grains moving into the pyrolysis bed 14 from the incineration bed have a relatively high thermal energy whereby necessary heat for the pyrolyzing process in the bed 14 is supplied from the grains moved thereinto from the incineration bed to maintain the pyrolyzing operation. On the other hand, carbon adhering to the grains or char produced in the pyrolysis bed 14 is incinerated in the incineration fluidized bed 15 when the movement of grains is in a direction from the bed 14 to the bed 15 whereby the grains are automatically regenerated in the chamber I before the grains are again moved into the bed 14 or the chamber R. In addition, the carbon or chars are incinerated in the chamber I to effectively raise the temperature of the grains. Even if the mixing of the gases between the two chambers is encountered in association with the movement of the solid grains, the amount of such mixing is negligible compared to the total volume of pyrolysis gas generated and, thus, pyrolysis gas having high calorific content is obtained. Further, as explained before, the bottom plate 16 is inclined so that any non-pyrolyzing and/or non-combustible residue that descends to the bottom of the beds is gradually moved on the plate 16 in the direction towards the discharge duct 20 and, thus, the residue is discharged only at one portion of the whole apparatus. Therefore, if the discharge duct is disposed below the chamber I and the inclination is arranged as illustrated in FIG. 2, the discharging is safely effected without the existence of combustible pyrolysis gas, whereby it is possible to simplify the operation and the device for such discharging.

The movement of the inert solid grains is effected based on the difference in pressure between the two chambers and, thus, the operation is simple and reliable and the total height of the apparatus is not required to be as high as in the case of the prior art twin bed pyrolysis system.

Figure 3:
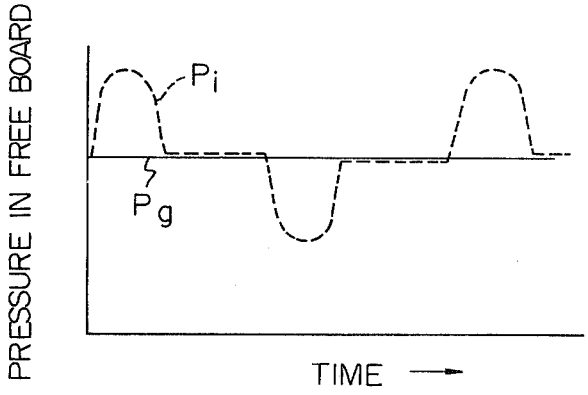
FIG. 3 is a graph showing an example of pressure regulation applicable to the apparatus shown in FIG. 2.

In practice, the pressure difference may be controlled as illustrated in FIG. 3 so that the upper levels in the fluidized beds 14 and 15 may be shifted to either of the upper limit level H, the neutral level N or the lower limit level L, respectively as illustrated in FIG. 2. The regulation or control for such shifting of the fluidized beds 14 and 15 may be performed simply by detecting the lower limit level L in either of the beds 14 or 15 and the temperature in the pyrolysis bed 14. For example, under the condition of $Pi<Pg$, the level of the fluidized bed 14 comes down to the lower limit L in a position illustrated in FIG. 2 whereat the pressure Pi is regulated so as to become equal to Pg ($Pi=Pg$). The regulation of the pressure Pi is easily performed by such as providing an appropriate damping means in the exhaust pipe 26.

When the respective levels of both the fluidized beds 14 and 15 reach the neutral level N, the temperature in the pyrolysis fluidized bed 14 once raised tends to fall to a predetermined lower limit temperature. Upon sensing such a lower limit temperature, the pressure Pi is regulated to achieve the condition of $Pi>Pg$ until the level of the incineration fluidized bed 15 reaches the lower limit level L whereat the pressure Pi is again regulated so as to become equal to Pg ($Pi=Pg$). In this stage, the temperature of the pyrolysis fluidized bed 14 once rises; however, it also tends to comes down again until the temperature of the bed 14 reaches the lower limit temperature for maintaining the pyrolysis process. At this point, the pressure Pi is further adjusted so that Pi becomes lower than Pg ($Pi<Pg$) until the condition illustrated in FIG. 2 is reinstated. By repeating the above cycles, the pyrolysis process is surely maintained within a certain range of temperature.

In the embodiment shown in FIG. 2, a control valve 30 is provided in the exhaust pipe 26 which is regulated by a signal from a pressure regulator 31. The pressure regulator 31 is connected to a pressure comparator 32 which compares the pressures Pg and Pi through pressure gauges $PI_1$ and $PI_2$ coupled to the freeboards 23 and 25, respectively. The information of the pressure difference obtained in the comparator 32 is forwarded to the pressure regulator 31 for appropriately setting the pressure Pi so that the predetermined pressure difference between Pg and Pi is attained. The temperature of the pyrolysis fluidized bed 14 is sensed by the thermometer $TI_1$ and the signal thereof is also transmitted to the pressure regulator 31 for effecting the movement of the inert solid grains between the two fluidized beds 14 and 15 as required. Also, a temperature setting device 33 is connected to the pressure regulator 31 for setting the comparator 32 to trigger the same when the threshold signal of the temperature is received from the thermometer $TI_1$.

The detection or sensing of the lower limit L for the level of the fluidizing beds is performed by a conventional means well known in the art.

Alternatively, the pressure difference between the gas chambers 17 and 18 and the freeboards 23 and 25, respectively may be utilized to sense the location of the level. Any other suitable means may also be utilized.

In the foregoing explanation, only the pressure Pi was regulated while the pressure Pg was kept constant since the regulation and handling in the combustion or exhaust gas system is easier than those in the pyrolysis gas system.

However, the regulation of the pressure is not limited to such procedure. For instance, only the Pg may be regulated while the Pi is maintained constant or both the pressures Pg and Pi may be regulated. As for example, a control valve 34 may be disposed in the outlet conduit 22 for regulating the pressure Pg.

In case the ratio of plastics included in the materials charged into the apparatus 10 is relatively high, the amount of char generated by the pyrolysis is small and, thus, thermal energy required for endothermetric reaction may not be sufficiently supplied only by relying on the production of the char. Under such circumstances, the position of the partition wall or dividing wall 19 for the gas chambers 17 and 18 in FIG. 2 may be moved to the position of the partition wall or dividing wall 19' illustrated in FIG. 4 wherein the same references as those in FIG. 2 are used for designating the elements similar to those in FIG. 2 with a prime added thereto, respectively. The amount of the reduction in the space or volume of the incineration gas chamber 18' is represented by Δ in the illustration of FIG. 4. By such shifting of the partition wall 19', it is possible to supply a part of the pyrolysis gas generated in the pyrolysis fluidized bed 14' for compensating the insufficient amount of the char.

Figure 4:
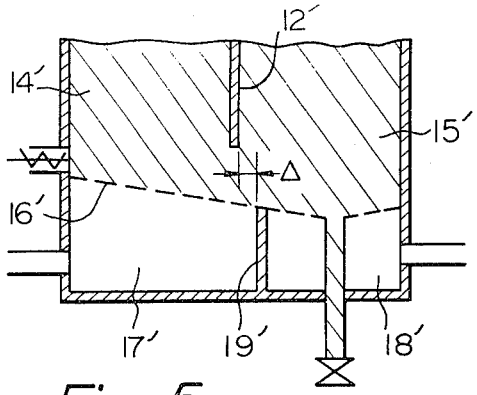
FIG. 4 is a fragmentary cross-sectional view of an apparatus modified from that shown in FIG. 2.

Namely, by shifting the partition wall 19' as illustrated in FIG. 4, a part of the pyrolysis gas is introduced into the incineration fluidized chamber I, whereby the proportion and/or ratio of the incineration or exhaust gas mixed with the pyrolysis gas is further reduced or minimized.

Incidentally, excessive gas mixing between both the fluidized beds may be prevented by defining the lower limit level L at a suitable height which is high enough above the upper end of the communication opening 13.

It may be contemplated also that the partition wall 19' may be designed to be adjustable to regulate the amount of Δ in accordance with the constituents of the material charged into the apparatus 10'.

Figure 5:
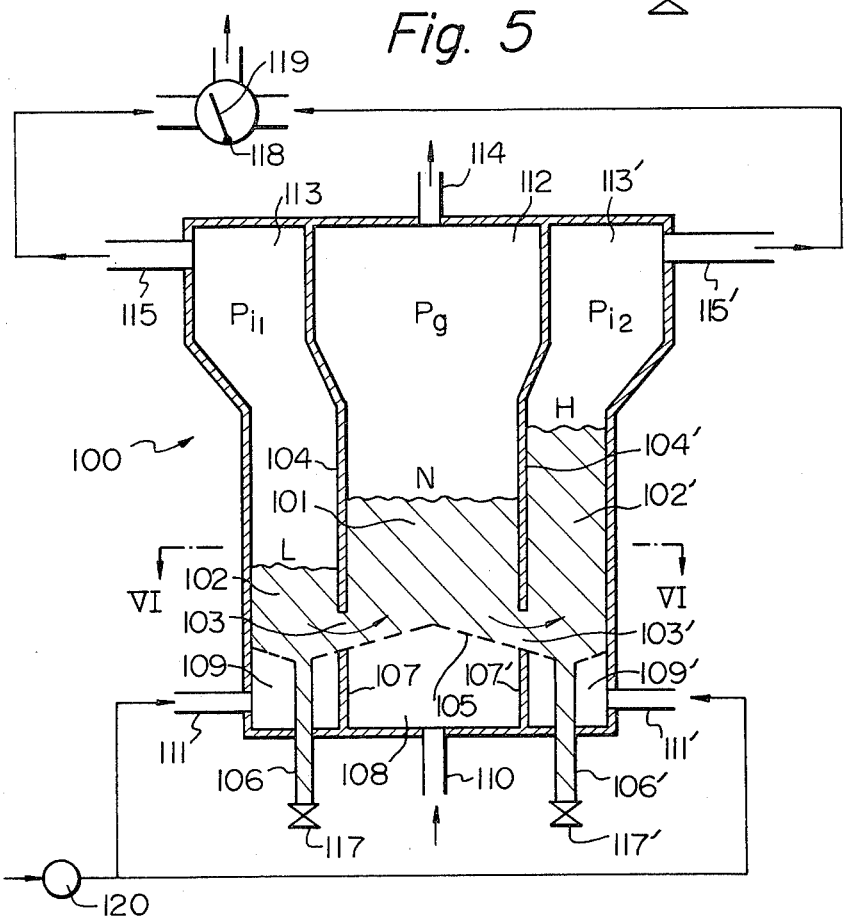
FIG. 5 is another embodiment according to the present invention shown in cross-section.
Figure 6:
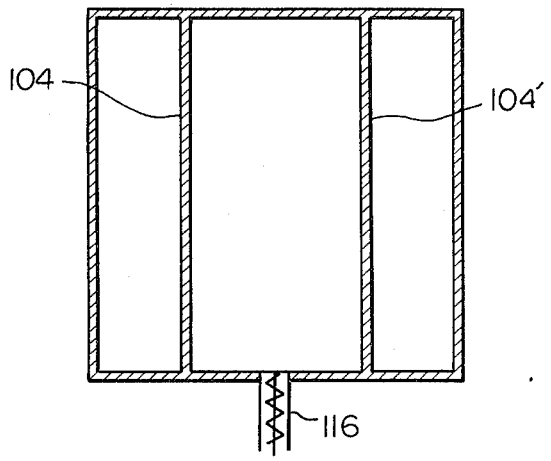
FIG. 6 is a horizontal cross-sectional view of the apparatus shown in FIG. 5.

A still further embodiment of a pyrolyzing apparatus 100 according to the present invention is illustrated in FIGS. 5 and 6. In this pyrolyzing apparatus 100, a pyrolysis fluidized bed 101 is provided so as to be sandwiched between two incineration fluidized beds 102 and 102', these beds 101, 102 and 102' being separated by partition walls 104 and 104' as illustrated in FIGS. 5 and 6. At the lower parts of the partition walls 104 and 104', communication openings 103 and 103' are provided, respectively similarly to the opening 13 in the wall 12 shown in FIG. 2. A perforated bottom plate or gas diffusion plate 105 for the fluidized beds 101, 102 and 102', is given inclinations as viewed in FIG. 5 so that the approximately center portions in the incineration fluidized beds 102 and 102' are arranged to be the lowest levels, respectively over the entire area of the bottom plate 105 and discharge conduits 106 and 106' are coupled to the center portions of the lowest levels so as to discharge the non-combustible residue therethrough. Similarly to the apparatus 10 shown in FIG. 2, double valves 117 and 117' are provided in the conduits 106 and 106', respectively. Under the bottom plate 105, partition walls 107 and 107' are disposed in vertical alignment with the partition walls 104 and 104', respectively so that a pyrolysis gas chamber 108 and incineration gas chambers 109 and 109' are formed under the bottom plate 105. Similarly to the embodiment shown in FIG. 2, a gas duct 110 is coupled with the gas chamber 108 for supplying an inert gas (oxygen free) thereinto and air conduits 111 and 111' from an air source 120 or sources are coupled with the gas chambers 109 and 109', respectively for supplying air under pressure thereinto. At the top of a free board 112 above the pyrolysis fluidized bed 101, an outlet conduit 114 is provided so as to take out the pyrolysis gas generated in the fluidized bed 101. Also, exhaust pipes 115 and 115' are connected to free boards 113 and 113' above the incineration fluidized beds 102 and 102', respectively so that exhaust gas is discharged outwardly through the pipes 115 and 115'. The exhaust pipes 115 and 115' in this case are interconnected with a three way damper 118 which will be explained later. The materals to be processed by the pyrolyzing apparatus are fed through a feeder 116 which is schematically shown in FIG. 6.

Figure 7:
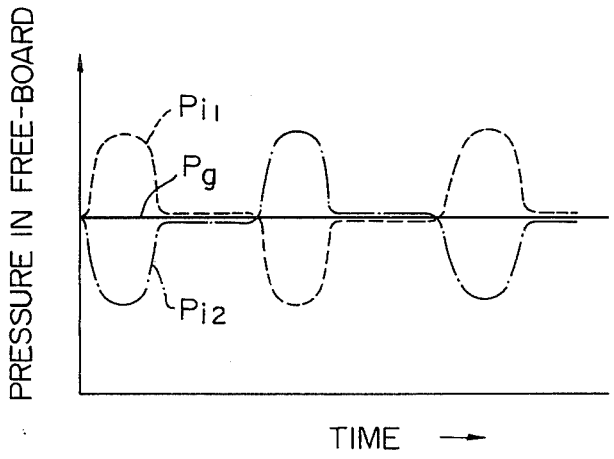
FIG. 7 is a graph similar to that shown in FIG. 3 and illustrates an example of pressure regulation applicable to the apparatus illustrated in FIGS. 5 and 6.

In the operation of the pyrolyzing apparatus 100, the pressure Pg in the free board 112 in the pyrolysis chamber is maintained substantially constant while the pressures $Pi_1$ and $Pi_2$ in the free boards 113 and 113' of the incineration chambers are varied with time in a manner such as illustrated in FIG. 7 so that a pressure difference is created between the pyrolysis fluidized bed 101 and the incineration fluidized bed 102 and between the bed 101 and the incineration fluidized bed 102', the pressure difference being alternately made to be positive and negative in both the fluidized beds 102 and 102' thereby effecting reciprocal movement of the inert solid grains between the pyrolysis fluidized bed 101 and the incineration fluidized beds 102 and 102'. In this embodiment, the level of the pyrolysis bed 101 may be maintained substantially at the same level, i.e., the neutral level N if the levels of the incineration beds 102 and 102' are varied inversely with each other within the range of the upper limit level H and the lower limit level L while causing the reciprocal movement of the inert grains between the beds depending on the pressure difference created as above. Similarly to the embodiment shown in FIG. 2, the control or regulation of the respective levels of the fluidized bed may be performed simply by detecting the lower limit levels L in the fluidized beds and the temperature in the pyrolysis bed 101.

For example, under the condition of $$Pi_1 > Pg > Pi_2; \text{ and}$$

$$Pi_1 - Pg = Pg - Pi_2,$$

the level of the incineration bed 102 comes down and that of the bed 102' goes up to the lower limit L and the upper limit H, respectively. When the levels above are reached as illustrated in FIG. 5 the respective pressures $Pi_1$ and $Pi_2$ are regulated so that $Pi_1$ and $Pi_2$ become equal to Pg. The simultaneous control of the pressures $Pi_1$ and $Pi_2$ may be performed by actuating the three way damper 118 so that pipes 115 and 115' are alternately restricted or closed with respect to the flowing gas by actuation of a valve plate 119 in the damper 118. When the levels of the incineration fluidized beds 102 and 102' return to the neutral levels N, the temperature of the pyrolysis fluidized bed 101 once raised by the heated grains introduced either from the beds 102 or 102' tends to fall. When the temperature thereof reaches a predetermined lower limit temperature for pyrolyzing operation, the pressures $Pi_1$ and $Pi_2$ are adjusted or regulated again so as to attain the condition of $$Pi_1 < Pg < Pi_2; \text{ and}$$

$$Pi_1 - Pg = Pg - Pi_2.$$

Thereafter, when the level of the incineration fluidized bed 102' reaches the lower limit level L, the pressures $Pi_1$ and $Pi_2$ are regulated to be equal to Pg. By such regulation as above, the level of the bed 102' again returns to the neutral level N. If the lower limit temperature is sensed in the pyrolysis fluidized bed 101, the pressure regulation is effected towards the condition illustrated in FIG. 5. By repeating the cycles explained above, the pyrolyzing process is surely and effectively carried out within a certain temperature range.

In the embodiment illustrated in FIGS. 5 and 6, it is noted that compared to the embodiment shown in FIG. 2, that the temperature variation in the pyrolysis fluidized bed is made less, since the level of the pyrolysis fluidized bed may be maintained substantially the same and, during the stage of movement of the solid grains between the fluidized beds, the heated grains are always introduced into the pyrolysis fluidized bed from either of the two incineration fluidized beds in contrast to the embodiment of FIG. 2, wherein the supply of heat energy to the pyrolysis fluidized bed is stopped when the solid grains move from the pyrolysis fluidized bed to the incineration fluidized bed.

In the embodiment shown in FIG. 5, two discharge conduits are provided. However, it is possible to give an inclination to the bottom plate in only one direction so that discharging of residue is effected at only one place.

Also, for the reason explained in connection with FIG. 4, the partition walls 107 and 107' may be made movable or adjustable so that the respective positions thereof are shifted outwardly, as viewed in FIG. 5, to utilize a part of the pyrolysis gas for compensating for insufficiency in the resources for generating thermal energy, i.e. char or the like in the incineration fluidized beds 102 and 102'.

Figure 8:
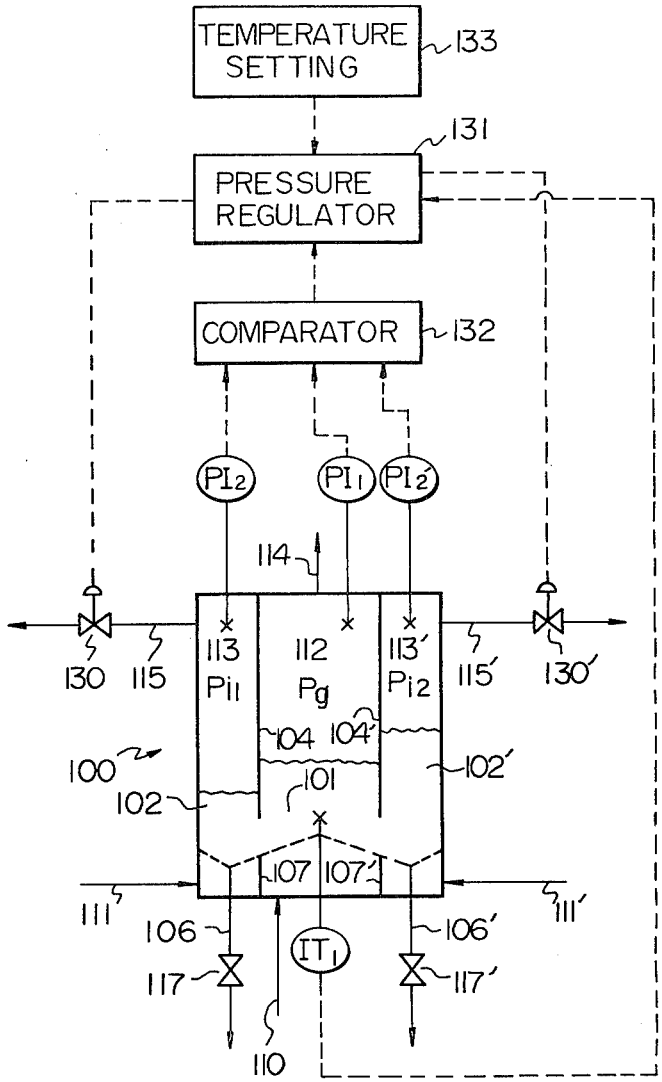
FIG. 8 is the same as that shown in FIG. 5 except for the modification of the pressure regulating system.

As to the control or regulation of the pressures in the free boards 112, 113 and 113' of the pyrolyzing apparatus 100 shown in FIG. 5, a modified form of the controlling system is illustrated in FIG. 8.

In FIG. 8, $PI_1$, $PI_2$ and $PI_2'$ are the pressure gauges for sensing the pressures Pg, $Pi_1$ and $Pi_2$ in the free boards 112, 113 and 113', respectively. In the outlet conduits 115 and 115', control valves 130 and 130' are disposed, respectively which are regulated by a pressure regulator 131. The pressure regulator 131 is controlled by a comparator 132 which determines the pressure difference between the pressures $Pi_1$, $Pi_2$ and Pg sensed by the gauges $PI_2$, $PI_2'$ and $PI_1$, respectively.

A thermometer $IT_1$ is placed in the pyrolysis fluidizing bed 101 to sense the temperature and the temperature information is fed to the pressure regulator 131.

In the foregoing, with respect to the regulation of the levels of the fluidized beds regarding the pyrolyzing apparatus 100 shown in FIGS. 5, 6 and 8, it has been explained that the level of the pyrolysis fluidized bed 101 is maintained substantially constant while the levels of the incineration fluidized beds 102 and 103 are varied inversely with each other. However, the operation of the apparatus is not limited to such arrangement. For instance, the level of only one of the incineration fluidized beds 102 and 103 may be regulated accompanied by the variation in level of the pyrolysis fluidized bed 101. Such operation may be considered when the temperature in either one of the incineration fluidized beds 102 or 103 is not enough for supplying thermal energy to the pyrolysis fluidized bed while that of the other is sufficiently high.

The pyrolyzing apparatus according to the present invention has been explained in connection with the pyrolyzing of municipal waste or the like; however, the apparatus of the present invention is not limited for treatment of such municipal waste or the like. For instance, the apparatus according to the present invention may be utilized for pyrolyzing coal for producing pyrolyzed gas and for other applications. In some cases, the raw material itself, i.e. pulverized coal, may be used in place of inert solid grains. In this case, the shape of the vessel may be preferably changed to one the horizontal cross section of which is cylindrical in shape rather than rectangular, such as illustrated in FIG. 6 to withstand the internal pressure, since the pyrolysis of coal is carried out under pressure, However, on such occasion, the partition walls 104 and 104' illustrated in FIG. 6 may be planar since the pressure difference created during the process or regulation are not so large as to necessitate any special consideration such as strengthening the walls.

Figure 9:
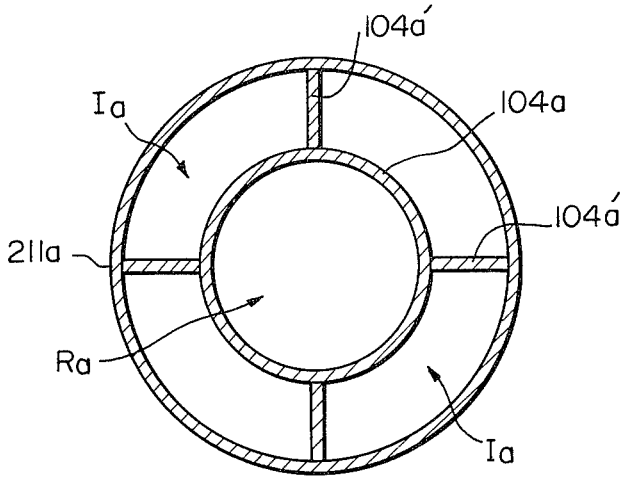
FIG. 9 is a horizontal cross-sectional view of an apparatus having plural incineration chambers.

In the embodiment illustrated in FIGS. 5, 6 and 8, two incineration fluidized beds 102 and 102' are provided. The number of fluidized bed chambers may be increased according to the present invention. For example, as illustrated in FIG. 9, a plurality of incineration fluidized bed chambers Ia are arranged to encircle a pyrolysis fluidized bed chamber Ra with partition walls 104*a* and 104*a'*, the wall 104*a* separating the chamber Ra and the chambers, Ia while the walls 104*a'* separate the chambers Ia from each other. Of course, there should be provided a communication opening in the wall 104*a* between the chamber Ra and each of the chambers Ia just above the bottom plate. Material is charged from the top of the free board in the chamber Ra or, from the lateral side of the chamber Ra at the position corresponding to one of the chambers Ia in which case that particular chamber is omitted and the space therefor is utilized for the material feeder and other associated devices.

Figure 10:
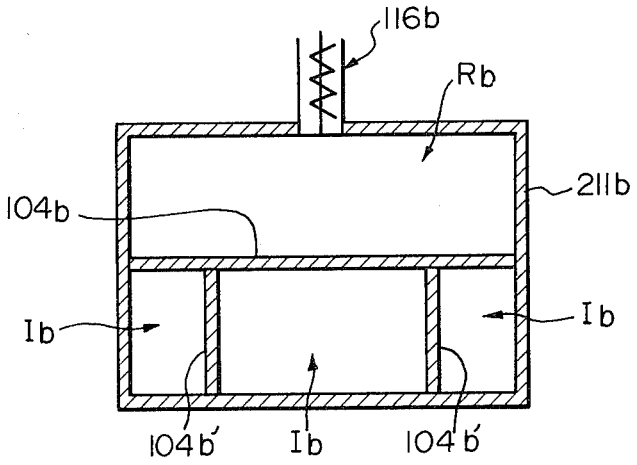
FIG. 10 is also a horizontal cross sectional view of another apparatus having plural incineration chambers.

In FIG. 10, another modified form of a pyrolyzing apparatus is shown which is provided with a plurality of incineration fluidized bed chambers Ib at one side of a pyrolysis fluidized bed chamber Rb with a partition wall 104*b* disposed therebetween. The chambers Ib are separated from each other by partition walls 104*b'* and each communicates with the chamber R through an opening just above the bottom plate. Material to be pyrolyzed is charged by a feeder 116*b* into the chamber Rb.

In either of the apparatuses illustrated in FIGS. 9 and 10, the levels of the respective fluidized beds are controlled or regulated in a way similar to those explained regarding the foregoing embodiments.

The present invention has been explained in detail referring to the particular embodiments thereof; however, it is to be understood that the present invention is not limited to those explained hereinabove and that modifications and changes thereof are readily available to those skilled in the art within the spirit and scope of the present invention defined in the claims appended hereto.

What is claimed:

1. A pyrolizing apparatus of a fluidized bed type comprising:

a vessel having a perforated bottom plate;

a pyrolysis fluidized bed chamber above said plate in said vessel;

an incineration fluidized bed chamber above said plate in said vessel, said chambers being in communication with each other at the lower portions of said chambers above said plate; and means for regulating the pressure difference between the free boards of said chambers;

wherein said regulating means regulates said pressure difference with elapse of time;

wherein said perforated bottom plate is inclined so that the lowest portion thereof is located below either of said incineration chamber or said pyrolysis chamber, and a discharge duct is connected to the bottom plate at its said lowest portion;

wherein a pyrolysis gas chamber and an incineration gas chamber are provided under said perforated bottom plate and below said pyrolysis fluidized bed chamber and said incineration fluidized bed chamber, respectively;

wherein said gas chambers are separated from each other by a dividing wall disposed therebetween; and wherein the position of said dividing wall is arranged to be adjustable so that a pyrolysis gas chamber may extend to a region partially below said incineration fluidized bed chamber.

2. A pyrolyzing apparatus as claimed in claim 1, wherein said regulating means is actuated in response to a predetermined low temperature in the pyrolysis fluidized bed.

3. A pyrolyzing apparatus as claimed in claim 1, wherein said regulating means is actuated when the level of either of the fluidized beds reaches a predetermined lowest position.

4. A pyrolyzing apparatus as claimed in claim 1 or 2 or 3, wherein said means for regulating the pressure difference comprises a damper disposed in at least one of the outlet conduits from the fluidized bed chambers.

5. A pyrolyzing apparatus of a fluidized bed type comprising:

a vessel having a perforated bottom plate;

a plurality of incineration fluidized bed chambers above said plate in said vessel;

a pyrolysis fluidized bed chamber above said plate in said vessel disposed so as to be directly adjacent each of said incineration fluidized bed chambers and in communication with each of said adjacent chambers above said plate; and means for regulating the pressure difference between a free board of said pyrolysis fluidized bed chamber and at least one of the free boards of said incineration fluidized chambers;

wherein a pyrolysis gas chamber is provided under said perforated bottom plate and below said pyrolysis fluidized bed chamber, and an incineration gas chamber is provided under said perforated bottom plate and below each of said incineration fluidized chambers;

wherein said pyrolysis gas chamber and said incineration gas chambers are separated from each other by a first partition wall disposed therebetween and said incineration gas chambers are separated from each other by second partition walls each disposed between adjacent chambers; and wherein the position of said first partition wall is adjustable so that a part of the gas upwardly fed from said pyrolysis gas chamber may be introduced into an incineration fluidized bed chamber or chambers.

6. A pyrolyzing apparatus as claimed in claim 5, wherein said regulating means is actuated in response to a predetermined low temperature in the pyrolysis fluidized bed.

7. A pyrolyzing apparatus as claimed in claim 5, wherein said regulating means is actuated when the level of one of the fluidized beds reaches a predetermined lowest position to regulate said level of said one bed.

8. A pyrolyzing apparatus as claimed in claim 5, wherein said means for regulating the pressure difference comprises a damper disposed in each of the outlet conduits from the incineration fluidized bed chambers.

9. A pyrolyzing apparatus as claimed in any one of claims 5 through 8 wherein the number of said incineration fluidized bed chambers is two, said pyrolysis fluidized bed chamber being sandwiched between said two chambers.

* * * * *